United States Patent [19]

Oswald

[11] 4,402,708

[45] Sep. 6, 1983

[54] DIALKYL AMINE DERIVATIVES OF PHTHALIC ACID

[75] Inventor: Alexis A. Oswald, Mountainside, N.J.

[73] Assignee: Exxon Research & Engineering Co., Florham Park, N.J.

[21] Appl. No.: 207,846

[22] Filed: Nov. 18, 1980

[51] Int. Cl.[3] ..... C10L 1/22; C10L 1/18

[52] U.S. Cl. ..... 44/66; 252/51.5 A; 44/70; 44/71; 44/62; 260/501.1

[58] Field of Search ..... 260/501.1; 252/51.5 A; 44/62, 70, 71, 66

[56] References Cited

U.S. PATENT DOCUMENTS

| | | | |
|---|---|---|---|
| 2,101,323 | 12/1937 | Salzberg . | |
| 2,892,778 | 6/1959 | Carter et al. | 252/33.6 |
| 2,915,464 | 12/1959 | Cantrell et al. | 252/32.5 |
| 2,971,027 | 2/1961 | Hotten | 260/558 |
| 3,095,286 | 6/1963 | Andress, Jr. et al. | 44/71 |
| 3,166,387 | 1/1965 | Ebner | 44/62 |
| 3,444,082 | 5/1969 | Kautsky | 252/51.5 |
| 3,544,467 | 12/1970 | Kautsky | 252/51.5 |
| 3,658,493 | 4/1972 | Hollyday, Jr. | 44/62 |
| 3,846,481 | 11/1974 | Gaydasch | 260/501.1 |
| 3,887,754 | 6/1975 | Walter | 428/407 |
| 3,982,909 | 9/1976 | Hollyday, Jr. | 44/66 |
| 4,210,424 | 7/1980 | Feldman et al. | 44/62 |
| 4,211,534 | 7/1980 | Feldman | 44/62 |

OTHER PUBLICATIONS

Research Disclosure 17052 of 1978—Disclosed Anonymously.

U.S. Ser. No. 549,753, pp. 5 thru 7.

*Primary Examiner*—Jacqueline V. Howard

*Attorney, Agent, or Firm*—Frank T. Johmann

[57] ABSTRACT

Oil-soluble, higher dialkyl amine derivatives, such as di-$C_{16}$ to $C_{40}$ alkyl amine amides and/or salts of ortho phthalic acid or anhydride are novel compounds useful as additives in distillate fuel oil.

18 Claims, No Drawings

DIALKYL AMINE DERIVATIVES OF PHTHALIC ACID

BACKGROUND OF THE INVENTION

This invention relates to the reaction products of secondary alkyl amines having alkyl groups in the range of 16 to 40 carbon atoms, and preferably 16 to 24 carbon atoms in a straight chain, with ortho phthalic acid or phthalic anhydride to form amides and/or salts useful as additives for distillate fuel oils, where they may be used in combination with wax crystal modifiers, for controlling the size of wax crystals that form in the oil at low temperatures, and for inhibiting agglomeration of the wax crystals. Various reaction products of long chain amines and dicarboxylic acids are known as fuel oil additives.

U.S. Pat. No. 3,095,286 teaches $C_4$ to $C_{30}$ alkyl phthalamic acids and their salts with $C_4$ to $C_{30}$ primary amines as distillate fuel oil additives to inhibit screen clogging, sedimentation and rust.

U.S. Pat. No. 3,166,387 discloses di-$C_{10}$ to $C_{22}$ alkyl ammonium salts, including dihydrogenated tallow amine salts, of a non-aromatic carboxylic acid, e.g. aliphatic carboxylic acids, as pour point depressants in distillate fuel oils. These salts may also be used as a synergist for hydrocarbon pour point depressants in distillate fuel oil.

U.S. Pat. Nos. 3,444,082 and 3,544,467 teach di-N,N-$C_{14}$ to $C_{28}$ alkyl substituted $C_{14}$ to $C_{28}$ alkenyl succinamic acids as additives for distillate fuel oils, which can be used in combination with ethylene copolymer wax crystal modifiers, such as copolymers of ethylene and vinyl acetate.

U.S. Pat. No. 3,658,493 teaches amides and salts of mono and di-carboxylic acids, which acids may be aliphatic or aryl, with amines including secondary amines, but wherein the amine has a single long chain alkyl group, as distillate fuel oil additives in combination with ethylene copolymeric pour point depressants.

U.S. Pat. No. 3,846,481 teaches di-N-octadecyl amine salts of aromatic monocarboxylic acids, such as benzoic acid, as a pour point depressant additive in distillate fuel oils.

U.S. Pat. No. 3,982,909 teaches salts and/or amides of dicarboxylic acids or its monoester, e.g. salts and amides of dicarboxylic acids such as maleic anhydride and ditallow amine, as middle distillate fuel oil additives or in combination with ethylene backbone pour point depressant or waxy hydrocarbons.

In addition to use in fuel oil compositions as noted above, various reaction products of long chain amines and cyclic dicarboxylic acids are also shown by the following for other uses.

U.S. Pat. No. 2,101,323 discloses N,N-dialkyl phthalamic acids and their alkali and alkali metal salts and wherein at least one of the alkyl groups is $C_8$ to $C_{18}$. The amine salts of the long chain compounds, presumably mono- and dialkyl phthalamic acids are said to show wetting and detergent properties.

U.S. Pat. No. 2,892,778 teaches salts and alkyl esters of N-monoalkyl terephthalamic acid as a blending agent for grease.

U.S. Pat. No. 2,915,464 teaches salts of $C_8$ to $C_{18}$ aliphatic amine and N-monoalkylphthalamic acid containing $C_8$ to $C_{18}$ alkyl groups as lubricating oil additives.

U.S. Pat. No. 2,971,027 teaches N,N'-dialkyl diamides of terephthalic acid as thickening agents for lubricating oil compositions.

U.S. Pat. No. 3,887,754 teaches di-N,N'-$C_8$ to $C_{22}$ alkyl diamides of phthalic, dihydrophthalic and tetrahydrophthalic acids.

An anonymous Research Disclosure 17052 of 1978 describes metal salts derived from phthalic acid and dihydrogenated tallow amine such as a salt of a phthalamic acid useful as lubricant additives.

THE INVENTION

The present invention represents a further improvement over U.S. Pat. No. 3,982,909 noted above, and is directed to oil soluble amides and/or salts or orthophthalic acid, or a monoester of orthophthalic acid having a $C_{16}$–$C_{40}$ alkyl group, and a dialkyl secondary amine having alkyl groups in the range of 16 to 40 carbon atoms. These compounds can be readily formed by the reaction of phthalic anhydride or its monoester, with alkyl amines, preferably secondary alkyl amines so as to form compounds having a minimum of three $C_{16}$–$C_{40}$, e.g. $C_{16}$–$C_{24}$ alkyl or alkenyl groups, preferably alkyl groups, of which at least two of said alkyl groups are of said secondary amine. Preferably at least one, and more preferably all, of the alkyl groups are straight chain. These compounds can be used as distillate fuel oil additives in the same general manner as described for the nitrogen compounds of U.S. Pat. No. 3,982,909 noted above. Thus the present compounds can be used as additives or as co-additives, e.g. as synergists, when a distillate fuel oil contains other wax crystal modifying agents such as waxy hydrocarbons or ethylene backbone pour depressants as disclosed in detail in U.S. Pat. No. 3,982,909, column 4, line 21 thru column 8, line 5, which disclosure is hereby incorporated into the present application. Examples of still other wax crystal modifiers are alkylated diphenyl ethers as disclosed in U.S. Pat. No. 4,014,663; hydrogenated polybutadiene as disclosed in U.S. Pat. No. 3,600,311; etc., which patent disclosures are incorporated herein in their entirety. The phthalic anhydride derivatives have been found to give low-cost additives which are particularly effective especially with regard to inhibiting agglomeration of the wax crystals that form.

Examples of $C_{16}$–$C_{40}$, preferably $C_{16}$–$C_{24}$ alcohols that can be used to make the monoester include 1-hexadecanol, 1-octadecanol, stearyl alcohol, behenyl alcohol, ceryl alcohol, tricosanol, etc.

Examples of $C_{16}$–$C_{40}$ secondary amines include N,N-dihexadecyl amine; N,N-dioctadecyl amine; N-hexadecyl, N-octadecyl amine; N,N-dieicosenyl amine; N,N-distearyl amine; N,N-dibehenyl amine; etc. A particularly useful amine is di-hydrogenated tallow amine, wherein the N-alkyl groups are derived from tallow fat, of which a typical composition is about 3% $C_{14}H_{29}$, about 34 wt. % $C_{16}H_{33}$ and about 63 wt. % $C_{18}H_{37}$ alkyl groups.

Of particular concern are the following orthophthalic derivatives:

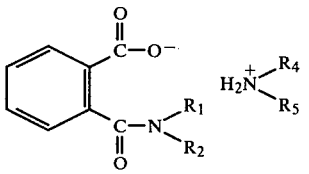

-continued tetraalkyl ammonium phthalamate particularly preferred,

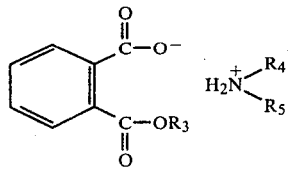

dialkyl ammonium monoalkyl phthalate, and

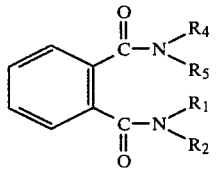

tetraalkyl phthalamide, wherein $R_1$, $R_2$, $R_4$ and $R_5$ are the $C_{16}$–$C_{40}$, preferably $C_{16}$–$C_{24}$ straight chain alkyl groups of the secondary amine, and may be the same or different, and $R_3$ is the $C_{16}$–$C_{40}$, preferably $C_{16}$–$C_{24}$ straight chain alkyl group of the alcohol. In its most preferred form, $R_1$ $R_2$, $R_4$ and $R_5$ are alkyl groups derived from tallow amine as discussed above.

The amides can be formed in a conventional manner by heating the secondary amine with the ortho phthalic acid or acid anhydride. Similarly, the ester is prepared in a conventional manner by heating the alcohol and the acid or anhydride to partially esterify the acid or anhydride (so that one carboxylic group remains for the reaction with the amine to form the amide or amine salt). The ammonium salts are also conventionally prepared by simply mixing the amine with the acid or acid anhydride, or the partial ester of a polycarboxylic acid, or partial amide of a polycarboxylic acid, with stirring, generally with mild heating.

The nitrogen compounds can be used in middle distillate fuel oils.

These distillate fuel oils will generally boil within the range of about 120° C. to about 500° C., e.g. 150° to about 400° C. The fuel oil can comprise atmospheric distillate or vacuum distillate, or cracked gas oil or a blend in any proportion of straight run and thermally and/or catalytically cracked distillates, etc. The most common petroleum distillate fuels are kerosene, jet fuels, diesel fuels and heating oils. The heating oil may be a straight atmospheric distillate, or it may frequently contain minor amounts, e.g. 0 to 35 wt. %, of vacuum gas oil and/or of cracked gas oils. The low temperature flow problem is most usually encountered with diesel fuels and with heating oils.

The fuel oil composition will comprise a major amount of the distillate fuel and about 0.001 to 0.2 wt. %, preferably 0.005 to 0.10 wt. % of the aforementioned oil soluble nitrogen compound. The fuel oil may contain other additives, for example wax crystal modifiers as previously noted, usually in amounts of 0.001 to 0.2 wt. %, preferably 0.005 to 0.10 wt. % each, wherein said weight percents are based on the weight of the total composition.

Oil soluble, as used herein, means that the additives are soluble in the fuel at ambient temperatures, e.g., at least to the extent of about 0.1 wt. % additive in the fuel oil at 25° C., although at least some of the additive comes out of solution near the cloud point in order to modify the wax crystals that form.

The invention will be further understood by reference to the following Examples which include preferred embodiments of the invention.

EXAMPLE I

Reaction of phthalic anhydride and dioctadecyl amine to form N,N-dioctadecyl phthalamic acid dioctadecyl ammonium salt.

104.4 g (0.20 m) of a commercial dioctadecylamine (Armeen 2HT which is a hydrogenated ditallow amine with a molecular weight of about 522) was diluted with 313.2 g toluene to obtain a 25% solution. The amine did not dissolve with stirring at room temperature. An additional amount of 104.4 g toluene was added to the mixture to obtain a 20% solution which did not dissolve the amine. Finally, an additional 522 g of toluene was added to the mixture to obtain a 10% solution. This mixture did not dissolve also, however on heating to 50° C. with stirring a clear, homogeneous and colorless mixture was obtained. This mixture remained clear, homogeneous and colorless to 32° C. at which time 14.8 g (0.10 m) phthalic anhydride was added to the amine solution. The reaction mixture was observed to be exothermic to 37° C. The mixture was allowed to cool to room temperature overnight.

It was observed that a small amount of white precipitate was present in the mixture. The mixture was then cooled in a freezer at −25° C. and a white solid crystalized. The material was filtered by suction using water vacuum and a Buchner funnel. During the filtration the solid was observed to be dissolving in the solvent as the reaction product was warming to room temperature while filtering. As a result, no solids remained on the Buchner funnel. The entire reaction mixture was then placed on a thin film evaporator and approximately ½ of the toluene was removed (about 500 ml). Then 500 ml n-heptane was added to the remaining reaction mixture which was then allowed to cool at −25° C. in a freezer overnight.

A white precipitate was present throughout the reaction product when it was removed from the freezer the next day. The reaction product (−25° C.) was filtered by suction using water vacuum and an ice cooled Buchner funnel. A small amount of white solid product was collected on the Buchner funnel, which was dried overnight in a desiccator under high vacuum to 0.10 mm. Hg pressure.

The white solid product weighed 19.70 g and is designated as Product I-A. The filtrate (mother liquor) was then film evaporated at 55° C. at 40 mm water vacuum to remove the toluene and heptane. The remaining residual yellow, clear liquid (when hot) turned to a yellow (light), waxy solid at room temperature.

The waxy light yellow solid was melted at 70° C. and then transferred to 2 crystalization dishes and dried in a vacuum oven at room temperature for 6 hrs, then at 35° C. for 16 hrs and 40° C. for 7 hrs and finally overnight at room temperature for 19 hrs. At 35° C. and 40° C. the product was sticky so final drying was done at room temperature where the product was solid.

The yellow solid product was removed from the vacuum oven and bottled. It weighed 84.80 g and is designated Product I-B.

Properties

Product I-A showed slight melting at 60°-65° C., some slow melting at 80°-85° C. with a main melting point of 87°-97° C.

Product I-B had a melting point of 60°-69° C.; a number average molecular weight (VPO) of about 1597; a Saponification No. of 47.2 mg. KOH/g; an Acid No. of 44.32 mg. KOH/g and a Base No. of 48.18 mg. KOH/g.

The carbon, hydrogen, oxygen and nitrogen analyses of Product I-B indicated an empirical formula of $C_{80}H_{154}O_3N_2$ and on a weight percent basis were as follows;

| | Found, Wt. % | Calculated, Wt. % |
|---|---|---|
| C | 80.62 | 80.60 |
| H | 12.86 | 13.02 |
| O | — | 4.03 |
| N | 2.25 | 2.35 |
| | | 100.00 |

EXAMPLE II

Reaction of phthalic anhydride and dioctadecylamine to form phthalic acid bis-dioctadecyl amide.

104.4 g (0.20 m) dioctadecylamine (Armeen 2HT) was placed into a 500 ml flask and then melted in an oil bath to a clear, homogeneous liquid, yellow in color at 120° C. Then 14.8 g (0.10 m) phthalic anhydride was added to the amine in the flask. The mixture was melted in an oil bath to a clear, homogeneous yellow liquid at 170° C. After mixing thoroughly, the reaction flask was attached to a short Claisen head and distillation set-up and then placed under water vacuum and heated to 250° C. to remove the water the reaction will produce as a by-product. The reaction mixture was heated at 250° C. at 80 mm water vacuum for 2½ hrs and also at 250° C. at 33 mm for 2½ hrs, to remove the water. After this period, the reaction product was observed to be orange in color and homogeneous. The reaction flask was weighed and there was a weight loss of 3.40 g (theoretical is 0.10 m $H_2O$ or 1.80 g). The product in the flask weighed 115.90 g. On cooling to room temperature, the product turned to a light tan, waxy solid.

Properties

The product had: a melting point, (Hot Stage Microscope) of 37°-40° C.; which started with slight melting at 36° C.; a number average molecular weight of 924; a Saponification No. of 19.3 mg. KOH/g; an Acid No. of 2.55 mg. KOH/g; and a Base No. of 22.30 mg KOH/g.

The carbon, hydrogen, oxygen and nitrogen analyses indicated an empirical formula of $C_{80}H_{152}O_2N_2$, and on a weight percent basis were as follows:

| | Found, Wt. % | Calculated, Wt. % |
|---|---|---|
| C | 81.98 | 81.84 |
| H | 12.70 | 13.05 |
| O | — | 2.72 |
| N | 2.30 | 2.39 |
| | | 100.00 |

EXAMPLE III

Reaction of phthalic anhydride and arachidyl amine to form N,N-diarachidyl phthalamic acid.

The amine used was a commercial arachidyl secondary amine available as Kemamine S-190, having a melting point of 171°-176° F., (about 77° C.), a combining weight of 624, and wherein the alkyl groups comprise about 90% arachidyl/behenyl groups and about 10% stearyl groups.

Into a 500 ml. Erlenmeyer flask equipped with a magnetic stirrer, were added 62.4 g (0.1 m) of the amine and 77.21 g of toluene. The amine/toluene mixture was then heated to 80° C. with stirring. At 80° C., a clear and colorless liquid resulted. Then 14.81 g (0.1 m) of phthalic anhydride was added to the stirred amine/toluene mixture. Within a few minutes all of the phthalic anhydride dissolved resulting in a clear and colorless liquid. The reaction mixture was then heated at 80° C. for 60 minutes. The solution remained a clean and colorless liquid on cooling to room temperature (R.T.). The 500 ml. Erlenmeyer flask was then transferred to the freezer (−30° C.) and left overnight. Crystallization occurred and a white cake resulted. The mixture was then filtered using a chilled Buchner funnel (−30° C.) under full water vacuum over the course of 3 hours. Hard white solids remained in the Buchner funnel, and only about 5 to 10 ml. of a clear very light yellow filtrate collected in the suction flask. The hard white solids were then washed with 50 ml. of toluene (−30° C.). A total of 25.0 g of the clear light yellow filtrate was collected in the suction flask and discarded. The white solids in the Buchner funnel were then transferred to a preweighed crystal dish. The dish contained 112.6 g. of the white solid. The white solids were then dried in a vacuum oven at 50° C. to 0.05 mm Hg. for 20½ hrs until no additional volatiles could be removed. The white solids weighed 65.3 g. in the crystal dish after oven drying and were transferred to a preweighed sample bottle. 65.2 g of the white solids were recovered as Product III. Needlelike crystals were observed on the inside of the glass window of the vacuum oven, which were scraped from the glass and tested for melting point. The melting point of these needlelike crystals was 128°-130° C. which indicated them to phthalic anhydride.

Product III had a Saponification Number of 82.8 mg. KOH/g of sample; (Calcd. Sap. No. was 77 mg. KOH/g); an Acid Number of 83.04 mg. KOH/g and a Base Number of 29.87 (at inflection) mg. KOH/gm.

Product III had a melting point of 57°-59° C.

The carbon, hydrogen, oxygen and nitrogen analyses of Product III-A (two determinations) are summarized below:

| | Found, Wt. % | | Calculated, Wt. % |
|---|---|---|---|
| C | 80.12 | 80.09 | 79.39 |
| H | 13.09 | 12.93 | 12.08 |
| N | 1.82 | .80 | 1.93 |
| O | 4.97 diff. | 5.18 diff. | 6.60 |
| | 100.00 | 100.00 | 100.00 |

The above analyses indicated an empirical formula of $C_{48}H_{57}NO_3$ which indicates the structure:

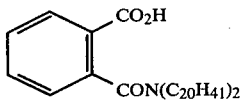

EXAMPLE IV

Preparation of N,N-diarachidyl phthalamic acid diarachidyl ammonium salt.

Into a 125 ml Erlenmeyer flask were added 17.6 g (0.023 m) of the N,N-diarachidyl phthalamic acid (Product III of Example III), and 17.6 g. of toluene. The mixture was then heated to 70° C. with magnetic stirring. At 70° C., all of the solids quickly dissolved in the toluene resulting in a clear and colorless liquid. Into a second 125 ml. Erlenmeyer flask were added 14.23 g (0.023 m) of the Kemamine S-190 amine (same as in Example III) and 14.23 g of toluene. The mixture was then heated to 70° C. with stirring. The amine gradually dissolved in the toluene resulting in a clear and colorless liquid. At 70° C., the acid solution was poured into the amine solution. No crystallization occurred and the combined mixture was a clear and colorless liquid. The 125 ml. Erlenmeyer flask originally with the acid and toluene mixture was mixed, i.e. rinsed with the total mixture to make sure the mixture was homogeneous. The 125 ml. Erlenmeyer flask containing the combined amine and acid solutions, which was fully insulated, was then allowed to cool to room temperature. At room temperature, crystallization occurred.

The white solids in the room temperature toluene were then filtered using a Buchner funnel under water vacuum. The white solids were hard and were washed with 30 ml. of toluene. Most of the toluene filtered from the solids. Some solids were observed in the filtrate. (See below). The white solids were then transferred from the Buchner funnel into a preweighed crystal dish. The dish contained 41.1 g. The solids were then dried in a desiccator overnight at room temperature to 0.04 mm Hg. pressure over the course of 24 hours. The dried white solids weighed 22.9 g. in the crystal dish and 22.8 g. of the dried white solids were saved as Sample IV-A.

The above-mentioned filtrate containing some white solids was then poured into a crystal dish and oven dried at 50° C. to 0.04 mm Hg. pressure in the vacuum oven. This dish contained 5.4 g of the dried white solids. 3.5 g. was saved in a sample vial and labeled as Sample IV-B.

Sample IV-A had a melting point: 66°–71° C. clear solid to 80° C. mobile.

Sample IV-A had a Saponification No. of 43.4 mg. KOH/g (Calculated, Saponification Number=43.4 mg. KOH/g sample), an Acid Number of 45.9 mg KOH/g sample at inflection; and a Base Number of 53.91 mg. KOH/g at inflection.

The weight % carbon, hydrogen, oxygen and nitrogen analyses of Sample IV-A are summarized below:

| | Found, Wt. % | Calculated, Wt. % |
|---|---|---|
| C | 81.54 | 81.92 |
| H | 13.11 | 13.28 |
| N | 1.96 | 1.09 |
| O | 3.39 | 3.71 |
| | 100.00 | 100.00 |

The above analyses give an empirical formula of: $C_{88}H_{170}NO_3$ which indicates the structure:

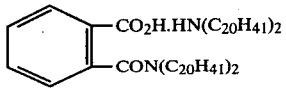

EXAMPLE A 0.02 wt. % of the product of Example I-B above was added to a middle distillate petroleum heating oil along with 0.04 wt. % of petrolatum as a wax crystal modifier. This petrolatum is an amorphous solid hydrocarbon fraction typically having a number average molecular weight of about 775 by vapor pressure osmometry, and a melting point of about 43° C., obtained by propane precipitation from a deasphalted residual stock from a Texas coastal crude oil. It contains about 5 wt. % isoparaffins, about 22 wt. % aromatic hydrocarbons and about 73 wt. % cycloparaffins.

EXAMPLE B 0.02 wt. % of the product of Example I-B above, was added to the heating oil of Example A along with 0.04 wt. % of a hydrogenated polybutadiene wax crystal modifier.

EXAMPLE C 0.02 wt. % of the product of Example I-B above, was added to the heating oil of Example A along with 0.04 wt. % of an alkyl diphenyl ether wax crystal modifier.

What is claimed is:

1. The oil soluble reaction product of phthalic anhydride or a $C_{16}$–$C_{40}$ alkyl monoester of orthophthalic acid, with 2 or 1 moles of a secondary dialkyl amine, respectively; wherein the alkyl groups are $C_{16}$ to $C_{40}$ alkyl groups of which at least one is straight chain and wherein said reaction product consists essentially of compounds selected from the group consisting of:

a. tetraalkyl ammonium phthalamate having the formula

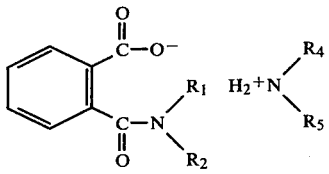

b. dialkyl ammonium monoalkyl phthalate having the formula

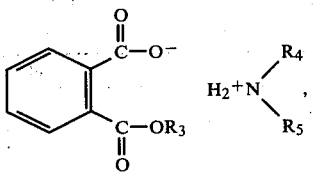

and c. tetraalkyl phthalamide having the formula

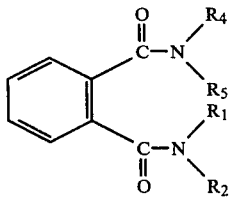

and wherein $R_1$, $R_2$, $R_3$, $R_4$, $R_5$ are $C_{16}$ to $C_{40}$ alkyl groups.

2. The reaction product of claim 1, wherein all of said alkyl groups are straight chain $C_{16}$–$C_{24}$ alkyl groups.

3. The reaction product of claim 1, wherein said product is a tetraalkyl ammonium phthalamate wherein one mole of phthalic anhydride and two moles of hydrogenated ditallow amine are reacted to form said product consisting essentially of N,N-dioctadecyl phthalamic acid dioctadecyl ammonium salt.

4. N,N-Dioctadecyl phthalamic acid dioctadecyl ammonium salt.

5. Phthalic acid bis-dioctadecyl amide.

6. Tetraalkyl phthalamide of the formula

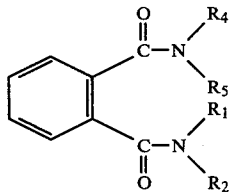

wherein $R_1$, $R_2$, $R_4$ and $R_5$ are $C_{16}$–$C_{40}$ straight chain alkyl groups and may be the same or different.

7. N,N-Diarachidyl phthalamic acid diarachidyl ammonium salt.

8. An amide salt of orthophthalic acid, formed by the reaction of phthalic anhydride and two moles of a secondary $C_{16}$ to $C_{40}$ alkyl amine, consisting essentially of compound of the formula

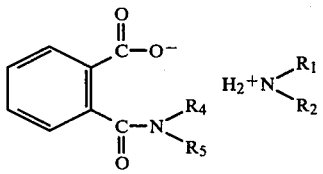

wherein $R_1$, $R_2$, $R_4$ and $R_5$ are $C_{16}$ to $C_{40}$ straight chain alkyl groups.

9. A diamide of ortho-phthalic acid, formed by the reaction of phthalic anhydride and two moles of a secondary $C_{16}$ to $C_{40}$ alkyl amine, consisting essentially of compound of the formula

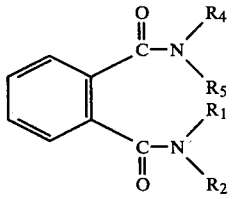

wherein $R_1$, $R_2$, $R_4$ and $R_5$ are $C_{16}$ to $C_{40}$ straight chain alkyl groups.

10. A middle distillate fuel oil containing 0:001 to 0.2 wt. % of the reaction product defined in claim 1.

11. A middle distillate fuel oil containing 0.001 to 0.2 wt. % of the reaction product defined in claim 2.

12. A middle distillate fuel oil containing about 0.001 to 0.2 wt. % of the phthalamic acid ammonium salt of claim 3.

13. A middle distillate fuel oil containing about 0.001 to 0.2 wt. % of the compound of claim 4.

14. A middle distillate fuel oil containing about 0.001 to 0.2 wt. % of the compound of claim 5.

15. A middle distillate fuel oil containing about 0.001 to 0.2 wt. % of the amide salt of claim 8.

16. A middle distillate fuel oil containing about 0.001 to 0.2 wt. % of the diamide of claim 9.

17. Tetraalkyl ammonium phthalamate of the formula:

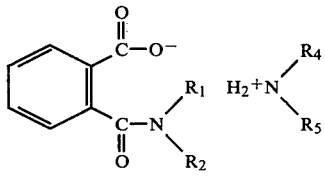

wherein $R_1$, $R_2$, $R_4$ and $R_5$ are $C_{16}$–$C_{40}$ straight chain alkyl groups and may be the same or different.

18. Dialkyl ammonium monoalkyl phthalate of the formula:

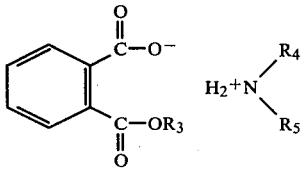

wherein $R_3$, $R_4$ and $R_5$ are $C_{16}$–$C_{40}$ straight chain alkyl groups and may be the same or different.

* * * * *